US011049389B2

(12) United States Patent
Madduri et al.

(10) Patent No.: US 11,049,389 B2
(45) Date of Patent: Jun. 29, 2021

(54) ACCIDENT PREVENTION DEVICE

(71) Applicant: INTERNATIONAL BUSINESS MACHINES CORPORATION, Armonk, NY (US)

(72) Inventors: Hari H. Madduri, Austin, TX (US); Cesar Augusto Rodriguez Bravo, Alajuela (CR); Michael Starkey, Prague (CZ)

(73) Assignee: International Business Machines Corporation, Armonk, NY (US)

( * ) Notice: Subject to any disclaimer, the term of this patent is extended or adjusted under 35 U.S.C. 154(b) by 898 days.

(21) Appl. No.: 15/811,765

(22) Filed: Nov. 14, 2017

(65) Prior Publication Data

US 2019/0147737 A1 May 16, 2019

(51) Int. Cl.
*G08G 1/01* (2006.01)

(52) U.S. Cl.
CPC ..... *G08G 1/0129* (2013.01); *G08G 1/012* (2013.01); *G08G 1/0116* (2013.01); *G08G 1/0145* (2013.01)

(58) Field of Classification Search
CPC .. G08G 1/0129; G08G 1/0116; G08G 1/0145; G08G 1/012
See application file for complete search history.

(56) References Cited

U.S. PATENT DOCUMENTS 9,187,099 B2 11/2015 Powers et al.
9,688,286 B2 * 6/2017 Wilkes, III ..... G08G 1/052
10,207,408 B1 * 2/2019 Ebrahimi Afrouzi ..... G06N 7/005
10,490,066 B2 * 11/2019 Green ..... G08G 1/081
10,621,670 B2 * 4/2020 Fuchs ..... G06Q 40/08
(Continued)

FOREIGN PATENT DOCUMENTS

JP 6045846 B2 2/2014
WO WO2016088067 A2 6/2016

OTHER PUBLICATIONS

Peter Mell et al, The NIST Definition of Cloud Computing, National Institute of Standards and Technology, Publication 800-145, 2011, entire document.

(Continued)

*Primary Examiner* — Genna M Mott
(74) *Attorney, Agent, or Firm* — Stephanie L. Carusillo

(57) ABSTRACT

Aspects provide a roadway management device having a processor configured to collect roadway attribute data associated with accidents within accident data and assign positive correlation values to roadway attributes that match the accident data. Aspects cluster subsets of the accidents that share common values of subset of the roadway attributes assigned positive correlation values; select a corrective action to obviate a one of the clustered roadway attributes; determine whether implementation of the selected corrective action has reduced occurrences of accidents matching common accident data of the clustered accidents on a relevant roadway; and increase a selection weighting value of the selected corrective action in response to determining that implementation has reduced accident occurrences. The selection weighting value is used to bias selection for implementation to obviate a roadway attributes with respect to other clustered accidents.

20 Claims, 5 Drawing Sheets

(56) References Cited

U.S. PATENT DOCUMENTS

| | | | | |
|---|---|---|---|---|
| 2001/0020902 | A1* | 9/2001 | Tamura | G01C 21/3697 340/905 |
| 2011/0077028 | A1* | 3/2011 | Wilkes, III | B60W 50/14 455/456.3 |
| 2015/0166072 | A1 | 6/2015 | Powers et al. | |
| 2016/0047666 | A1* | 2/2016 | Fuchs | G06Q 40/08 701/423 |
| 2016/0358081 | A1 | 12/2016 | Cama et al. | |
| 2018/0190111 | A1* | 7/2018 | Green | G08G 1/0145 |

OTHER PUBLICATIONS

Association for Saft International Road Travel, Annual Global Road Crash Statistics, http://asirt.org, 2002-2017, entire document.

Mohamed Abdel-Aty et al, The viability of real-time prediction and prevention of traffic accidents, 2017, entire document.

Rupa Jagannathan et al, Springer, Predicting Road Accidents Based on Current and Historical Spatio-temporal Traffic Flow Data, International Conference on Computational Logistics, ICCL 2013, entire document.

Yisheng LV et al, Real-Time Highway Traffic Accident Prediction Based on the k-Nearest Neighbor Method, IEEE, 2009, entire document.

Mohamed Abdel-Aty et al, The Potential for Real-Time Crash Prediction, ITE Journal on the Web, Dec. 2005, pp. 69-75.

Stay Ziv, U.S. Traffic Deaths, Injuries and Related Costs Up in 2015, Newsweek, 2015, pp. 1-10.

* cited by examiner

ACCIDENT PREVENTION DEVICE

BACKGROUND

Traffic management concerns planning and control of transport services and infrastructure for the movement of vehicles (for example aircraft, road vehicles, rolling stock and watercraft). Road traffic control refers to systems and infrastructure used to manage vehicular and pedestrian traffic flows upon roadways, generally to comply with standards and regulations designed to ensure minimal levels of safety for motorists or pedestrians utilizing or impacted by roadways. Traffic control systems may be dynamic and responsive to close circuit television (CCTV) imagery and other data inputs, to monitor traffic to actively manage traffic flows and provide advice concerning traffic congestion.

Traffic control may be responsive to general and short-term loading requirements, for example, using temporary diversions or detours to route anticipated loads around a construction zone, accident or other road disruption, and reduce traffic congestion where feasible. Traffic congestion is a condition on transport networks that occurs as use increases, and is characterized by slower speeds, longer trip times, and increased vehicular queueing. When traffic demand is great enough that the interaction between vehicles slows the speed of the traffic stream, this results in some congestion. Mathematically, congestion is usually looked at as the number of vehicles that pass through a point in a window of time, or a flow. Congestion flow lends itself to principles of fluid dynamics.

Traffic control measures also generally consider public safety issues. For example, permanent roads and temporary detours are planned to minimize traffic flow impediments while using roadways that are designed to adequately handle anticipated loading with respect to amounts of vehicles and the required speeds to efficiently move them along without causing congestion, include road surfaces and bridges rated to handle anticipated vehicle loads, and have grades, turns, intersections and general and signal lighting and illumination levels that meet anticipated loading needs without increasing hazards or risk of accidents for moving vehicles, pedestrians, emergency response teams, construction workers and the general public.

SUMMARY

In one aspect of the present invention, a computerized method for a roadway management device includes executing steps on a computer processor. Thus, a computer processor is configured to collect structured and unstructured roadway attribute data that is associated with each of a plurality of different accidents within historic accident data, and assign positive correlation values to correlated ones of the roadway attributes that match to the accident data. The configured processor clusters subsets of the different accidents as a function of sharing a threshold amount of common values of a subset of the roadway attributes that are assigned positive correlation values; selects a corrective action to obviate a first one of the subset of the roadway attributes that is assigned positive correlation values of the clustered subset of accidents; determines whether implementation of the selected corrective action has reduced occurrences of accidents matching common accident data of the clustered subset of accidents on a relevant roadway; and in response to determining that implementation of the selected corrective action has reduced occurrences of accidents matching common accident data of the clustered subset of accidents on the relevant roadway, increases a selection weighting value of the selected corrective action. The selection weighting value is used to bias selection of the selected corrective action for implementation to obviate a roadway attribute with respect to another clustered subset of the accidents comprising roadway attributes that are assigned positive correlation values and that includes the first one of the subset of the roadway attributes.

In another aspect, a system has a hardware processor in circuit communication with a computer readable memory and a computer-readable storage medium having program instructions stored thereon. The processor executes the program instructions stored on the computer-readable storage medium via the computer readable memory and is thereby configured to collect structured and unstructured roadway attribute data that is associated with each of a plurality of different accidents within historic accident data, and assign positive correlation values to correlated ones of the roadway attributes that match to the accident data. The configured processor clusters subsets of the different accidents as a function of sharing a threshold amount of common values of a subset of the roadway attributes that are assigned positive correlation values; selects a corrective action to obviate a first one of the subset of the roadway attributes that is assigned positive correlation values of the clustered subset of accidents; determines whether implementation of the selected corrective action has reduced occurrences of accidents matching common accident data of the clustered subset of accidents on a relevant roadway; and in response to determining that implementation of the selected corrective action has reduced occurrences of accidents matching common accident data of the clustered subset of accidents on the relevant roadway, increases a selection weighting value of the selected corrective action. The selection weighting value is used to bias selection of the selected corrective action for implementation to obviate a roadway attribute with respect to another clustered subset of the accidents comprising roadway attributes that are assigned positive correlation values and that includes the first one of the subset of the roadway attributes.

In another aspect, a computer program product for a roadway management device has a computer-readable storage medium with computer readable program code embodied therewith. The computer readable hardware medium is not a transitory signal per se. The computer readable program code includes instructions for execution which cause the processor to collect structured and unstructured roadway attribute data that is associated with each of a plurality of different accidents within historic accident data, and assign positive correlation values to correlated ones of the roadway attributes that match to the accident data. The processor is caused to cluster subsets of the different accidents as a function of sharing a threshold amount of common values of a subset of the roadway attributes that are assigned positive correlation values; select a corrective action to obviate one of the subset of the roadway attributes; determine whether implementation of the selected corrective action has reduced occurrences of accidents matching common accident data of the clustered subset of accidents on a relevant roadway; and in response to determining that implementation of the selected corrective action has reduced occurrences of accidents matching common accident data of the clustered subset of accidents on the relevant roadway, increase a selection weighting value of the selected corrective action. The selection weighting value is used to bias selection of the selected corrective action for implementation to obviate a roadway attribute with respect to another clustered subset of the accidents comprising roadway attributes that are assigned positive correlation values and that includes the first one of the subset of the roadway attributes.

BRIEF DESCRIPTION OF THE DRAWINGS

These and other features of embodiments of the present invention will be more readily understood from the following detailed description of the various aspects of the invention taken in conjunction with the accompanying drawings in which.

DETAILED DESCRIPTION

Figure 1:
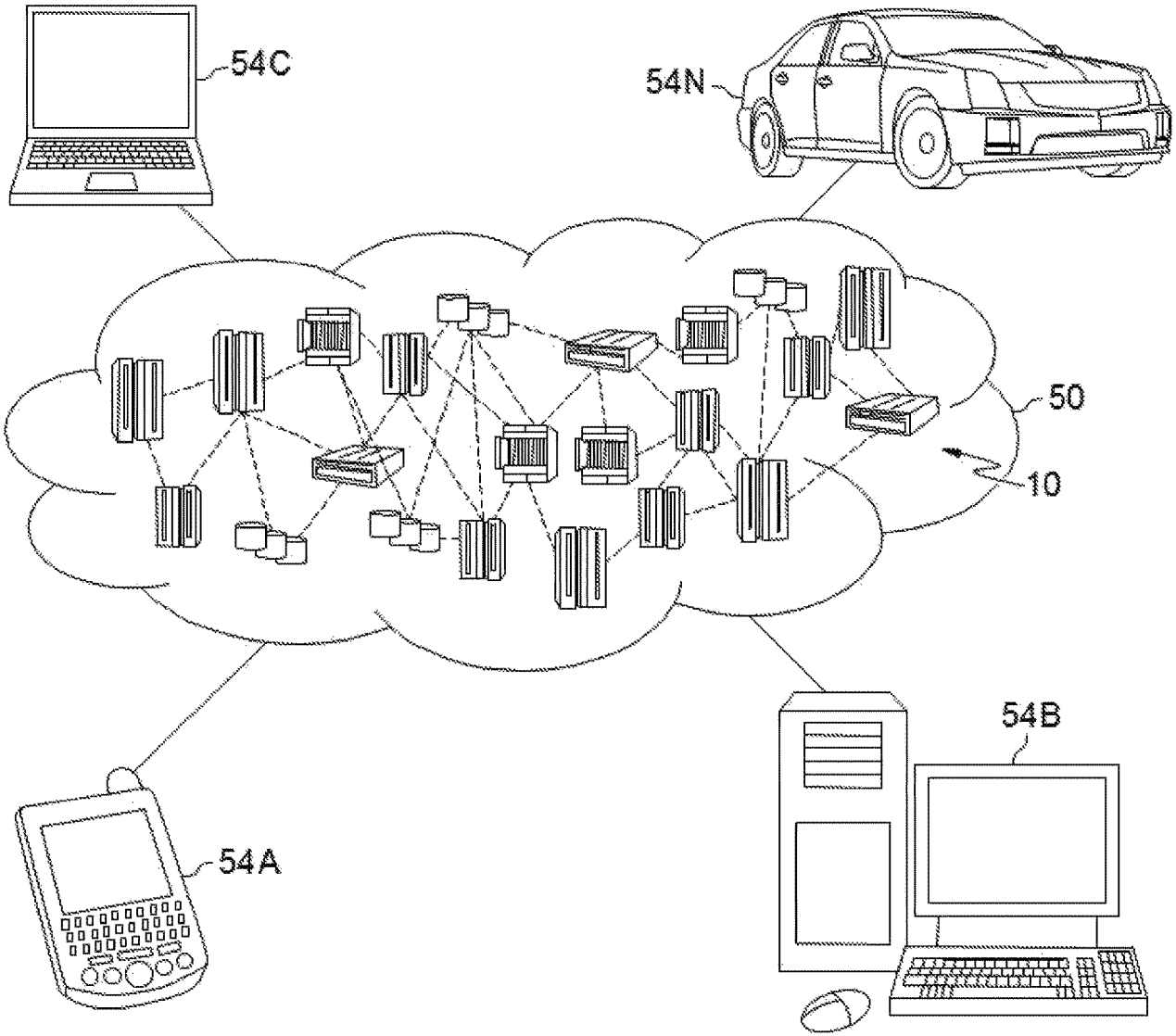
FIG. 1 depicts a cloud computing environment according to an embodiment of the present invention.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and be rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
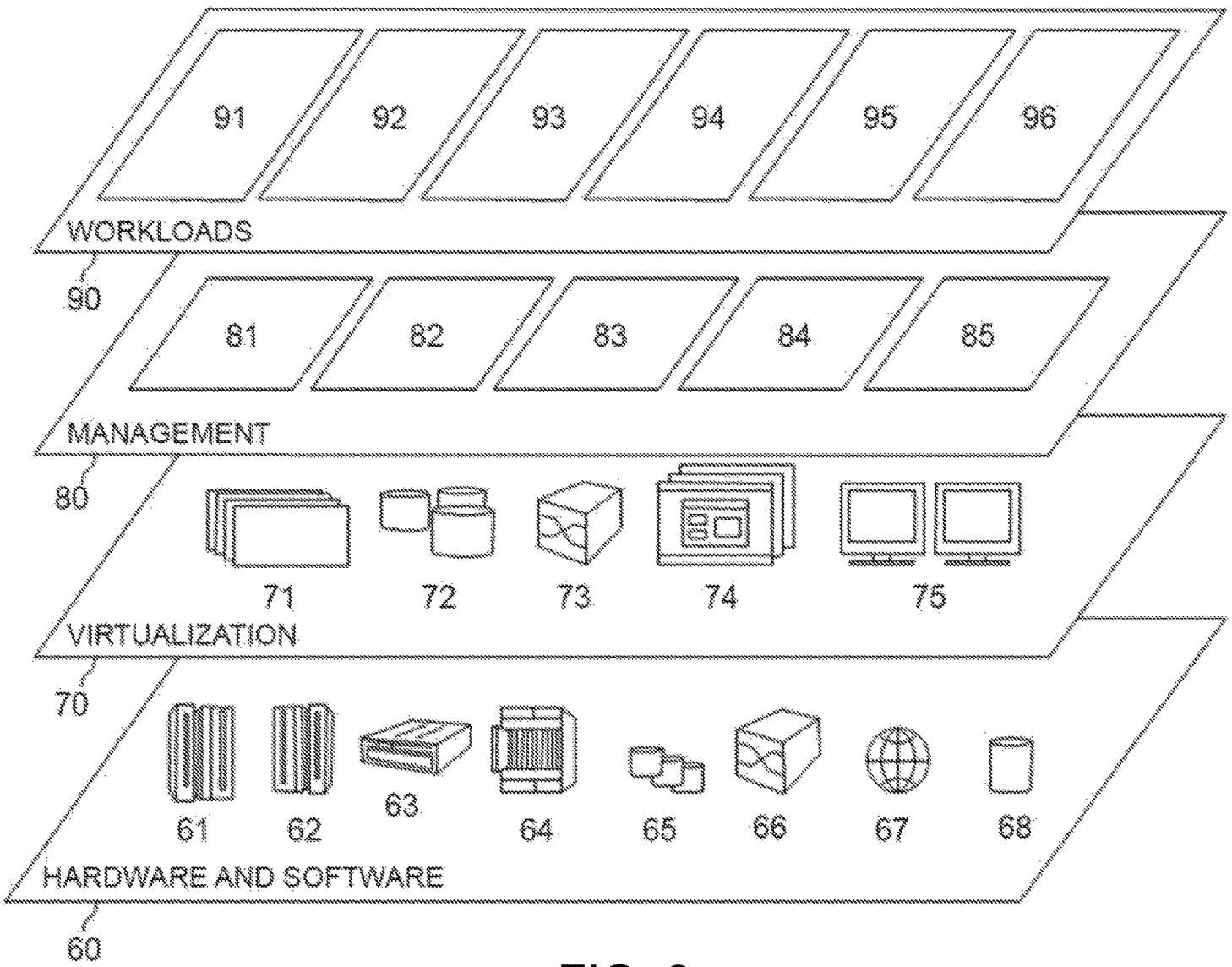
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and processing for an accident prevention system or device according to aspects of the present invention 96.

Figure 3:
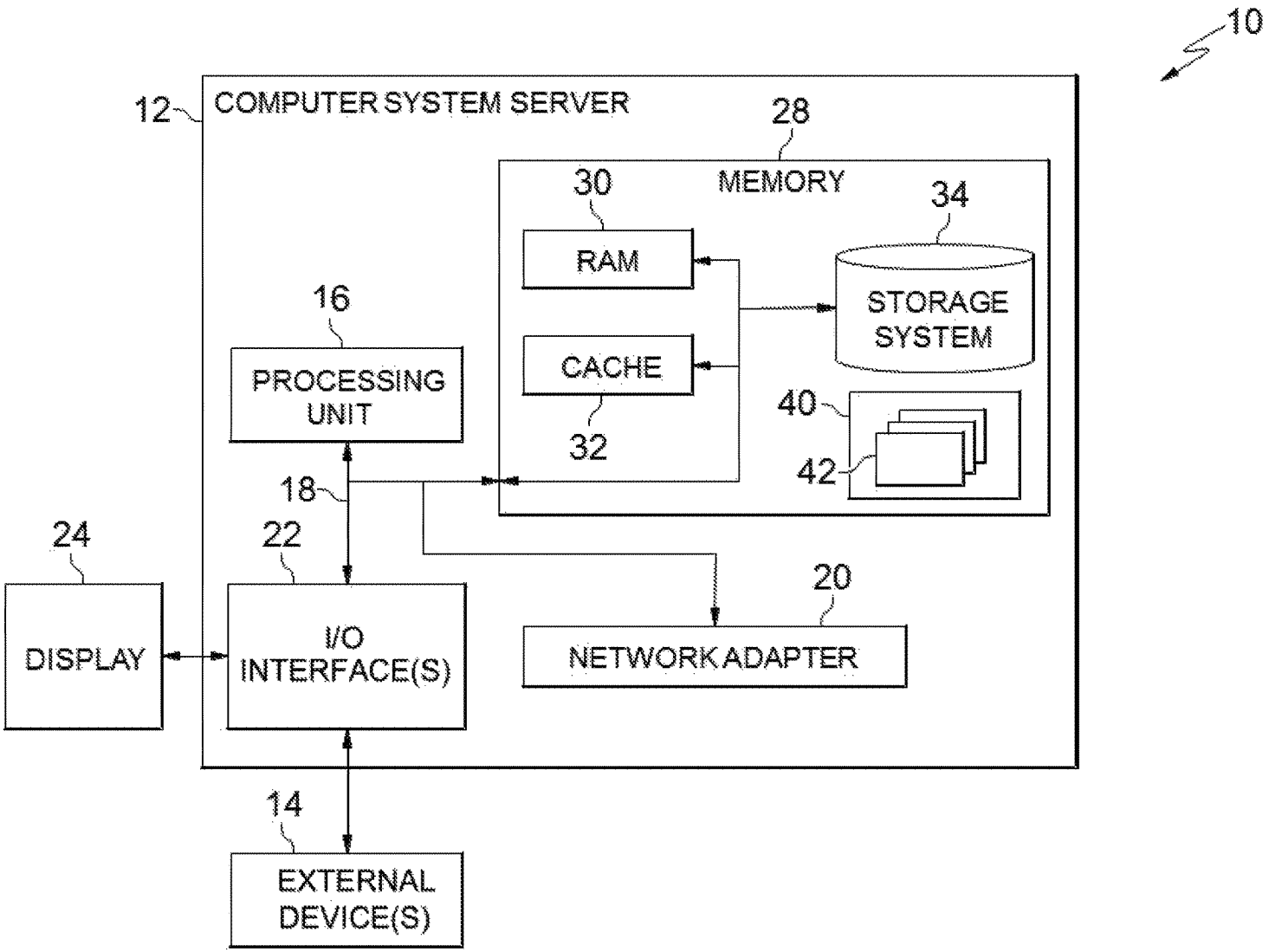
FIG. 3 depicts a computerized aspect according to an embodiment of the present invention.

FIG. 3 is a schematic of an example of a programmable device implementation 10 according to an aspect of the present invention, which may function as a cloud computing node within the cloud computing environment of FIG. 2. Programmable device implementation 10 is only one example of a suitable implementation and is not intended to suggest any limitation as to the scope of use or functionality of embodiments of the invention described herein. Regardless, programmable device implementation 10 is capable of being implemented and/or performing any of the functionality set forth hereinabove.

A computer system/server 12 is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

The computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32.

Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 4:
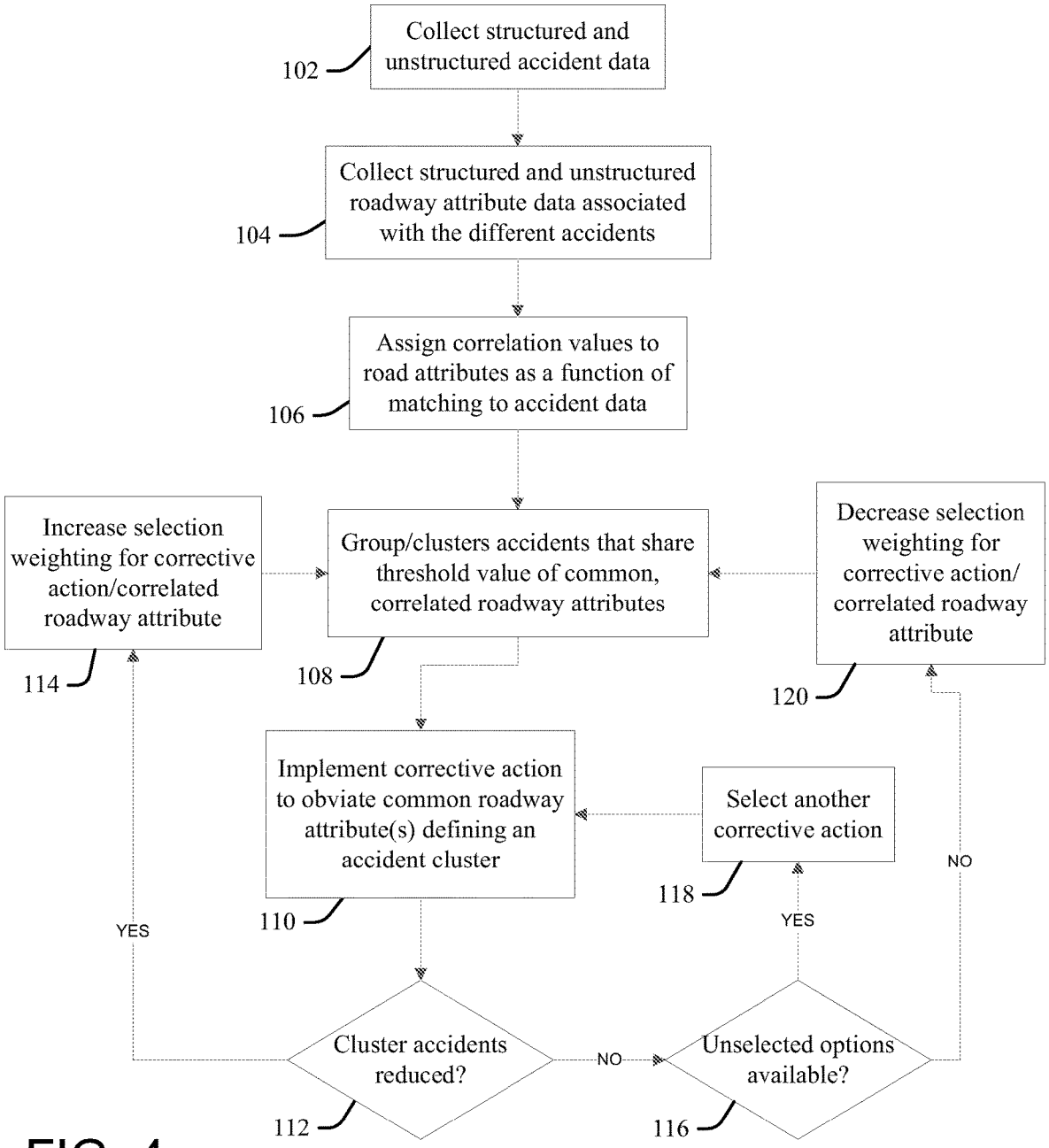
FIG. 4 is a flow chart illustration of an embodiment of the present invention.

FIG. 4 illustrates a roadway management device or structure according to the present invention. At 102 a processor configured according to an aspect of the present invention (the "configured processor") collects structured and unstructured accident data for each of a plurality of individual accident incidents (accidents) that occurring within a region that includes a roadway. The collected accident data includes labeled and/or structured data (reported causes of current and historic accidents, dates and times, type of accident, type of transportation involved, behavior and demographics of vehicle operator or pedestrian) and unstructured data (text narrative details about an accident, bystander opinions and observation data, for example, opinions as to visibility and reaction time, such as the roadway was clear of visual obstructions, or crowded due to traffic jam, large trucks, etc.).

At 104 the configured processor collects structured and unstructured roadway attribute data that is associated with each of the different accidents. The collected roadway attribute data may be current as well as temporally distant (over a past time period, or projected into the immediate future), and illustrative but not limiting or exhaustive examples of the collected roadway attribute data include:

Current, past and forecast weather conditions, regionally or for a given roadway or area or other granularity, including temperature, humidity, dew point, visibility (clear and sunny, rain, snow, ice, windy, still, sleet, ice storm, temperature inversion, fog, smog, etc.), and accumulated rain and snow totals (for example, inches of snow in the past 24 hours), warnings and predictions of impending snowstorms or hurricanes or other events prompting evacuation travel or trips to purchase supplies, etc.

Visibility: including distances and/or or reaction times relevant to unobstructed visibility relative to oncoming traffic and intersections (for example, from traffic engineer assessment data and traffic sensors), and illumination levels (for example, values of lumens of light from sunlight or artificial (street) lighting. Sunlight lumens values may be determined as function of latitude and longitude and calendar date and weather conditions; object contrast at determined illumination (for example, direct sunlight or streetlight illumination with strong shadow contrast/low visibility in shadows, or diffuse lighting with low contrast/higher visibility in shadows from cloudy, overcast daytime conditions).

Traffic loading: amounts and rates of flow of traffic, for example, volume and average and actual speeds of travel along roadway determined from traffic sensors.

Road surface conditions: uniformity rating of road surface (for example, value reflecting average percentage or likelihood that a lane surface cross-section is impacted by potholes, cracks, speed bumps or other disruptions that have a negative impact on consistent, safe and reliable forward travel), in-progress work, maintenance, vandalism, and speed bumps located at or proximate to accidents.

Lane routing configurations: lane or street closures impacting traffic flow, changes of traffic direction or flow, including timeliness of dynamic or relatively recent changes or assignments of roadway or lanes thereof as one-way or within two-way lane assignments, limitations to high-density vehicles (two or more passengers) or buses, or opening of lane to single-occupant vehicles and/or truck traffic), etc.

Calendar event data: accident occurrences during or outside of holidays, weekdays, weekends, school session days, sporting events, political events and other assembly events that increase or decrease traffic.

Still other roadway attribute data collected at 104 appropriate data will be apparent to one skilled in the art.

At 106 the configured processor assigns correlation values to the roadway attributes as a function of matching to the accident data, reflecting an amount or degree of correlation (or no correlation) of the roadway attributes to the accident data. Thus, the configured processor may populate a field value for a "cloudy/low visibility" roadway attribute in response to determining the same as weather conditions of the roadway at the time of an accident, either from the accident data (for example, from a police report) or by retrieving historic weather data for the roadway at the time and date of the accident.

In some examples, the configured processor uses a scoring system in which each roadway attribute or factor is given positive values (for example, one (1) or more points) for correlation to or matching the accident data. Determining and storing accident data in association with correlated/matched roadway attributes within a database or other registry may also be dependent on meeting a requirement that a threshold number of roadway attributes are assigned the point value, or total of attribute values meets the threshold (for example, at least five (5) different roadway attributes have values, or total of their values is at least 5).

Correlation values may be assigned by the configured processor at 106 based on relative weightings. For example, an accident location or street address correlation may be given a higher weighting value (due to a higher importance relative to other roadway attributes) such as a value of three (3) points, which may increase the likelihood that a total of attribute values meets an applicable threshold for recording the correlation data within a registry/database.

At 108 the configured processor groups or clusters accidents that share a threshold value of common, correlated roadway attributes, wherein the value is determined by number of correlated roadway attributes, or total of values allocated to the roadway attributes, or as a function of both. For example, where a minimum correlation threshold number of the roadway attributes is three (3), two different accidents that occur on different roads (or at different locations remote from each other by a threshold distance value on a common roadway) are grouped together in a common cluster with each other as a function of sharing common values for four different roadway attributes: weather forecast or snow accumulation amount of greater than two (2) inches, lighting level of cloudy/low shadow contrast, roadway surface of macadam with less than 30% un-uniform (pot-holed or cracked) cross-sectional surface, and speed limit of 35 miles per hour).

Correlation groupings and clusters may also be dependent on meeting a total valuation threshold for selected (specified) ones of the roadway attributes, and said values may be differentially weighted. For example, where a threshold for a total of correlated roadway attribute numbers is three (3), two accidents happening on a same roadway and sharing a weather condition may be clustered together as a function of sharing a total value of four (4) points worth of specified roadway attribute values points that are allocated to their common specified attributes, where the common roadway attribute is a specified correlation attribute and assigned a value of three (3) points, and the shared weather condition is a specified correlation attribute and assigned a value of one (1) point. In another example two other accidents are clustered in response to sharing common roadway attributes of four different roadway attributes that are each allocated one (1) correlation point: roadway condition, weather, holiday occurrence and rated speed limit.

At 110 the configured processor identifies (selects) and directly implements (or causes another entity to implement) a corrective action to remedy, correct or obviate one or more of the shared, common roadway attribute values defining the cluster of accidents.

At 112, the configured processor determines whether implementation of the corrective action identified 110 has reduced the occurrence of accidents matching common accident data of the clustered subset of accidents (as defined by or relevant to common attributes of the clustered accidents) on the relevant roadways.

If determined at 112 that implementation of the corrective action identified at 110 has reduced accidents defined by/relevant to the cluster, then at 114 the configured processor provides positive feedback in increasing or otherwise modifying a selection weighting value for the selected corrective action, wherein the selection weighting value is used for selection and implementation to an associated one of the subset of the roadway attributes with respect to other clustered subsets of the accidents that share a threshold value of common values of other subsets of the roadway attributes assigned positive correlation values that includes the associated roadway attribute, that lead to accident reductions when implemented (at 110) is associated with those other clusters.

If determined at 112 that implementation of the selected corrective action identified at 110 has not reduced accidents defined by/relevant to the cluster, then at 116 and 118 the configured processor iteratively selects and tries alternative implementations of corrective actions until accidents are reduced (at 112), or no further options are left for selection at 116.

In response to determining that no further options are left for selection at 116, at 120 the configured processor provides negative feedback with respect to modifying (reducing) or otherwise modifying the selection weighting values for each of the selected corrective actions and/or their associated road attributes for which corrective action implementations failed to achieve reductions in accidents within the accident clusters, for use in future clustering at 108. For example, at 120 the configured processor lowers the selection weighting value for an obviated roadway attribute, or an obviation strategy that fails to result in lower accident occurrences, for selection and implementation with respect to other cluster groupings at 110.

The feedback processes at 114 and 120 defines a learning process that adjusts corrective action and/or road attribute weightings to reflect the successful or unsuccessful reduction of accidents, for use in actions taken with respect to other, future clustering at 108. The feedback provides revision inputs for cognitive learning processes at 108, which may include determining if an initial assessment was not accurate. Thus, the configured processor defines a cognitive engine that improves future results: for example, weighting an obviated roadway attribute associated with the corrective action that results in lower accident occurrences more highly than another for selection for obviation within a cluster grouping, or removing consideration of a certain calendar event when future accident observation rates determined at 112 reliably shows no traffic impact from the event relative to another day).

Collection of the accident data at 102 and the roadway attribute data at 104 is agnostic as to meaning or labelling of the data relative to likelihood of accident causation. While it may comprehend data that is pre-determined and labeled with positive, negative or neutral values with respect to likelihood of being a contributive cause to an associated accident, it also comprehends unlabeled data, that for which no qualitative or quantitative assessment is made, or value assigned with respect to likelihood of being a contributive cause to the associated accident.

Prior art traffic management systems generally design roadway infrastructures to minimize or safely accommodate or ameliorate roadway attributes that are historically associated (labelled) with high frequencies of accidents. Examples included road conditions (for example, poor lighting, lack of visibility, road paving or construction type or materials used, inadequate traffic signals, camber or grade of road, etc.) and anticipated external factors (for example, regular snow and ice and other inclement weather conditions, observed and predicted traffic load surges due to employment and education commuting and logistics demands that vary over time of day, week or season, temporary disruptions from construction, mass assembly events, etc.). More particularly, the prior art systems identify the presence or impact of certain attributes on roadways that are known to increase accident risk, and then take steps to reduce the risks presented: for example, rerouting an intrastate route designation from one road to another that has better (less likely to cause an accident) sight-lines, curvature and grade attributes for anticipated speed of traffic; enacting parking bans during snow storms; dynamically revised traffic signaling during rush hours; improving roads surfaces and traffic signaling in response to recognizing increasing traffic loading; etc.

However, the efficacy of accident prevention measures taken or recommended by such prior art systems are limited to ameliorating roadway attributes that are individually identified with lower safety statistics. Such approaches may actually reduce safety, such as where drivers choose to utilize alternative roads to avoid safer routes in an attempt to cut commute times, thereby increasing accidents or the risk thereof on the alternate routes chosen. Further, implemented measures may have unintended consequences: for example, accidents may increase on some roadways during good weather in response to configurations designed to reduce accidents during inclement weather, due to increase speeds of travel by motorists during the good weather conditions.

Some aspects of the present invention use clustering to capture relationships between accidents and combinations of road attributes, and thereby discover new relationships of road attributes to accidents that are otherwise unknown or even counterintuitive. Aspects gather large amounts of condition attribute data with regard to roadways, including both negative attributes (those that are historically associated (labeled) with values indicating a high or higher risk of accidents), and positive attributes (those that are historically associated (labeled) with values indicating a low or lower risk of accidents) which are generally ignored or disregarded from consideration in the prior art in identifying dangerous road conditions. By considering both positive and negative attribute data, aspects identify roadway attribute clusters or combinations that are indicative of a high accident risk, which include combinations of individually positive values that in combination result in an aggregate increased likelihood of accident.

Aspects of the present invention use comprehensive analytics to consider large amounts of data, enabling proactive identification and learning of an unlimited and unique roadway attribute clusters or combinations that are indicative of a high accident risk, wherein automated systems may automatically adjust roadway traffic management resources to change current roadway conditions to create the presence of different attribute clusters or combinations that are safer from current determined or detected attribute combinations. Aspects may thus predict the future occurrence of accident incidents, by projecting future times of convergence of roadway attributes into clusters or combinations identified to be strongly associated with accidents in historical data, and proactively prevent accidents by revising one or more of the clustered attribute values at said future time of convergence, to thereby create a different attribute cluster or combination that is associated with a lower risk of accident at that time, enabling better accident occurrence rate outcomes.

Revising one or more of the clustered attribute values (at 110, FIG. 4) may be achieved by proactive and efficient deployment of resources. For example, with respect to projecting a future time period of convergence of a first group of attributes for a first roadway portion that includes a first attribute wherein a high percentage of motorists are observed to speed (exceed a posted speed limits) on the roadway during the future time period; a second attribute of dry roadway conditions, a third attribute of an overlap with a time of commute of students and employees of a school, and a fourth attribute of day of week as Monday, and wherein removing this first attribute from the cluster generates another cluster of attributes that is historically associated with no reported accidents, aspects may take steps to remove or revise the value of the first attribute (for example, by dispatching and stationing a police car to be visible to motorists on the roadway portions ahead of during the future time period, so that motorists refrain from speeding, in order to avoid a traffic citation). As the cluster indicates (requires) that the heightened accident rate occurs only on Mondays, aspects may more efficiently allocate resources relative to the prior art: a total number of available police cars is generally limited, and by only stationing the police car on Mondays on this road portion, the police car is available during the weekdays at the same time period, in effect creating additional resources to serve other needs relative to prior art systems that would station the police car every week day or other day that the school is in session. During said other week days aspects of the present invention can instead deploy this police car (and other public safety resource) to another place where there is a relatively higher chance that an accident will occur during this future time period (wherein a composite attribute cluster has a higher strength of association to accident of occurrence), to thereby more likely prevent an accident, than had the police car been allocate to the road portions; or enabling faster response to an accident elsewhere, by generally increasing police car availability.

While prior art systems rely upon historic data and statistics to project accidents and accordingly allocating staffing and other resources from direct associations to specific road attribute values, aspects of the present invention utilize cognitive and analytic systems to identify unknown and otherwise unrecognized associations to groups of attributes that, taken singly (for example, good pavement conditions and weather), are contra-indicative of the likelihood of accidents in the prior art. By recognizing the effects of composite groupings of different attributes that are not historically linked to higher risks of accidents, aspects expand the pro-active capabilities of traffic management systems.

Aspects of the present invention consider a wide variety of data sources to discover patterns, and use cognitive engines to propose solutions with varying confidence levels for different outcomes. By observing and recording the results of solutions implemented over a period of time, solutions may be tested in isolation or in combination (for example, a road closure, a detour, a reduction in posted speeds or installation of speed bumps, etc.), wherein the configured processor cognitively determines or learns which solutions or combinations thereof provide good, better or best results, and which are most appropriate to implement in other locations (including via consideration of other accident cluster groupings). The systems learn over time from feedback, including based on outcome data associated with implementations of selected solution, the results achieved for a given solution (and thereby associated with a different cluster of attributes, as a given solution will result in changing one or more of the attribute values). Aspects combine multiple facets of cognitive solutions, understand large amounts of unstructured data, discover patterns in the data, draw insight into root causes, and determine potential solutions via machine learning.

In deploying big (structured and unstructured) data analysis, clustering attributes discovers connections between accidents and seemingly unrelated factors (weather attributes, city events, etc.), enabling more reliable accident risk predictions that are based on all factors combined. Aspects learn over time from ratings feedback as to prediction accuracy, fine tuning prediction models to generate progressively better (more accurate) accident predictions.

By considering unstructured data that comprehends both positive and negative road attributes, cognitive engine according to the present invention predict which routes are more prone to an accident on a given date and time, enabling proactive road closures, or detours where alternate, safer routes are available. Aspects may proactively add resources to certain zones or areas experiencing heightened risk of accident, and alert public safety resources about the heightened possibility of accidents on a given route on a given date/time, which may further indicate which kinds of vehicles are more vulnerable to being affected (for example, bicycles or motorcycles, or pedestrian collisions within cross-walks, in view of historic accident reports). In one example, in response to determining that cluster of condition attributes (35% of vehicles exceeding posted speed limits, wet weather, streetlighting lumens level at nighttime, 65% average uniformity rating of road surface cross-section) that are projected to occur during a current time period (over the next six hours) on a given road has a 90% strength of association to motorcycle accidents over the past five year (and less than 10% strength of association to vehicles or pedestrians), aspects of the present invention may reduce (or cause other systems to reduce) posted speed limits (via dynamic speed limit signs) by 20%, or dispatch a police car to monitor traffic and pull over motorcyclists that exceed the speed limit by smaller margin than typically used to stop a motorist (for example, for exceeding the limit by 5 miles-per-hour, wherein the typical margin that must be exceed to trigger a stop is usually 9 miles-per-hour), and/or with instructions to issue a citation on a first stop, rather than just a warning unless the motorcyclist has been stopped twice before, as is customary in this jurisdiction.

By determining attribute clusters aspects may identify correlations not otherwise apparent from road conditions considered separately. For example, in response to determining that two (first and second) clusters of attributes that are associated with different accident rates have common values for all attributes (for example, 35 mile-per-hour speed limit in good weather conditions with good road surface uniformity) except for time of day (wherein the first cluster is during an afternoon rush hour period and the second is immediately after the afternoon rush hour period) indicates that the later time of day of the second cluster associated with the higher accident rate is more dangerous/hazardous to drivers relative to the rush hour time for the same, exact road conditions, leading to taking proactive measures during this more-dangerous time of day for the road portions shared the common cluster of road attributes (for example, deploying police to randomly select between different 35 mile-per-hour speed limit roads with good road surface uniformity in good weather conditions for enforcement speed limits during the second time period. Aspects thereby allocate the enforcement resources to the most likely time of accident for the clustered conditions, enhancing the use of resources in a more effective way relative to focusing on rush-hour time periods (as is typical in prior art approaches that focus instead on a general correlation of the higher traffic volumes of the rush hour period to a higher likelihood of accidents).

By ingesting large amounts of data and continually discovering (learning) new connections between road attribute combinations and accident occurrences, aspects may utilize long time frames to identify failures of correlations or matches between accidents and road attributes within prior art, traditional accident statistical models over long historic periods. Aspects may thus construct better predictive models considering additional factors not contemplated by the prior art, traditional accident statistical models. Aspects may constantly learn to associate additional attributes and factors with accidents, and validate the correlations, including assigning confidence factors, which may be used to adjust the weight of different attributes associated with accidents within a cluster.

Figure 5:
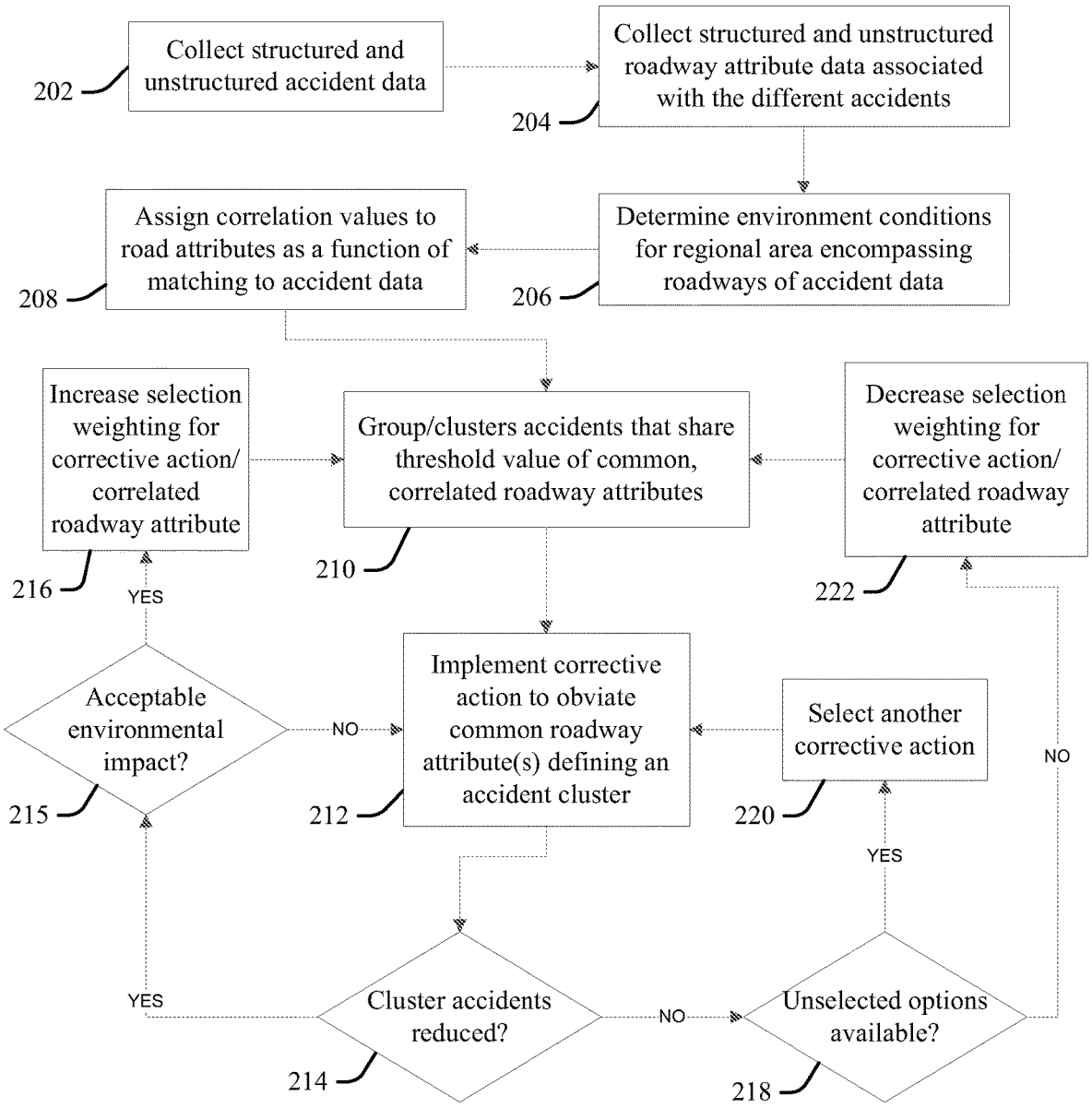
FIG. 5 is a flow chart illustration of an alternative embodiment of the present invention.

FIG. 5 illustrates another embodiment of the present invention that incorporates environmental impact analysis to ensure that accident reduction strategies also provide environmental benefits, or at least minimize negative environmental impacts. At 202 a processor configured according to an aspect of the present invention (the "configured processor") collects structured and unstructured accident data for each of a plurality of individual accident incidents (accidents) occurring within a region that includes a roadway (as discussed above with respect to 102 of FIG. 4). At 204 the configured processor collects structured and unstructured roadway attribute data that is associated with each of the different accidents (as discussed above with respect to 104 of FIG. 4).

At 206 the configured processor determines environment conditions for a regional area encompassing the roadways of the accident data. For example, the configured processor monitors or determines current or baseline levels of noise, emission and other environments stressors or pollutions; mass transit usage; fuel consumption.

At 208 the configured processor assigns correlation values to the roadway attributes as a function of matching the accident data, reflecting correlation (or no correlation) of the roadway attributes to the accident data (as discussed above with respect to 106 of FIG. 4).

At 210 the configured processor groups or clusters accidents that share a threshold value of common, correlated roadway attributes, (the value determined by number of correlated roadway attributes, or total of values allocated to the roadway attributes, or as a function of both, as discussed above with respect to 108 of FIG. 4).

At 212 the configured processor identifies (selects) and directly implements (or causes another entity to implement) a corrective action to remedy, correct or obviate one or more of the shared, common roadway attribute values defining the cluster of accidents.

At 214, the configured processor determines whether implementation of the corrective action identified 110 has reduced accidents defined by or relevant to the cluster on the relevant roadways.

If determined at 214 that implementation of a corrective action identified has reduced accidents defined by/relevant to the cluster, then at 215 the configured processor determines whether the implementation of the corrective action has had an acceptable environmental impact on the region encompassing the roadways. Thus, at 215 the configured processor may determine whether the implemented action has increased levels of noise, emissions and other environments stressors or pollutions; decreased mass transit usage; or increased energy usage or fuel consumption. For example, alternative roadway routing that reduces accidents may also create unacceptable levels of noise or environmental pollution within the same region, or within a neighboring, impacted region, such as when such routes are not configured to minimize such impacts to surrounding communities.

The analysis at 215 compares reductions in accident rates by current traffic control measures to environmental effects, and balances accident reductions against said effects. For example, the configured processor may require that a threshold percentage of accident reductions be met to justify an increase in a negative environmental impact (for example, more fuel usage, more greenhouse gas or vehicle emissions, less mass transit fare revenue or usage, increased noise); otherwise, the configured processor moves back to step 212 to select and implement an alternative approach. Aspects may thus revise traffic control measures to reduce negative environmental impacts, at a cost of accepting a maximum amount of increase in projected accident rates or risk. Such determinations may be context dependent: for example, for a region projected to experience a temperature inversion weather condition within the next 48 hours that will increase smog and ozone levels experienced by persons within the region, aspect may adjust traffic control measures to decrease overall emissions (restrict driving hours by name or license plate), at a cost of a projected increase in the risk of pedestrian/bus accidents, as the overall improvement in air quality will lower risk to the respiratory health of the pedestrians by a greater margin than the (comparatively smaller) increase in the risk that will be hit by a bus over the same time period.

In response to determining at 215 that an implemented solution has an acceptable environmental impact, at 216 the configured processor provides positive feedback in modifying the weightings of the road attribute within the accident clusters that lead to accident reductions, in a learning process that adjusts clusters or road attribute weighting to reflect the successful reduction of accidents defined by the cluster at acceptable levels of environmental impact, for use in future clustering at 210 and corrective action selections at 212.

If determined at 214 that implementation of a corrective action has not reduced accidents defined by/relevant to the cluster, then at 218 and 220 the configured processor iteratively selects and tries alternative implementations of corrective actions until accidents are reduced (at 214) via a solution that has an acceptable environmental impact (at 215), or no further options are left for selection at 218, wherein at 222 the configured processor provides negative feedback with respect to modifying (reducing) the weightings of each of the road attributes for which corrective action implementations failed to achieve reductions in accidents within the accident clusters (and, if applicable, at an acceptable level of environmental impact), for use in future clustering at 210 and solution selection at 212.

The terminology used herein is for describing aspects only and is not intended to be limiting of the invention. As used herein, the singular forms "a", "an" and "the" are intended to include the plural forms as well, unless the context clearly indicates otherwise. It will be further understood that the terms "include" and "including" when used in this specification specify the presence of stated features, integers, steps, operations, elements, and/or components, but do not preclude the presence or addition of one or more other features, integers, steps, operations, elements, components, and/or groups thereof. Certain examples and elements described in the present specification, including in the claims, and as illustrated in the figures, may be distinguished, or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations, or process steps.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method for a roadway management device, the method comprising executing on a computer processor:

collecting structured and unstructured roadway attribute data that is associated with each of a plurality of different accidents within historic accident data;

assigning positive correlation values to correlated ones of the roadway attributes that match to the accident data;

clustering a subset of the accidents as a function of each of the subset of the accidents sharing a threshold amount of common values of a subset of the roadway attributes assigned positive correlation values;

selecting a corrective action to obviate a first one of the subset of the roadway attributes that is assigned positive correlation values of the clustered subset of accidents;

implementing the selected corrective action by revising a posted speed limit displayed on a dynamic speed limit sign;

determining whether the implementing the selected corrective action has reduced occurrences of accidents matching common accident data of the clustered subset of accidents on a relevant roadway; and in response to determining that the implementing the selected corrective action has reduced occurrences of accidents matching common accident data of the clustered subset of accidents on the relevant roadway, increasing a selection weighting value of the selected corrective action; and using the selection weighting value to bias selection of the selected corrective action for implementation to obviate a roadway attribute with respect to another clustered subset of the accidents comprising roadway attributes that are assigned positive correlation values and that includes the first one of the subset of the roadway attributes.

2. The method of claim 1, further comprising:

in response to determining that the implementing the selected corrective action does not reduce occurrences of accidents matching common accident data of the clustered subset of accidents on the relevant roadway, decreasing the selection weighting value of the selected corrective action.

3. The method of claim 1, wherein the first one of the subset of the roadway attributes is not labeled as being a contributive cause to an associated accident within the clustered subset of accidents.

4. The method of claim 1, wherein the threshold amount of common values is selected from the group consisting of a total number of the subset of the roadway attributes assigned positive correlation values, and a total of the positive correlation values assigned to the subset of the roadway attributes assigned positive correlation values.

5. The method of claim 1, wherein the roadway attribute data is selected from the group consisting of weather conditions, illumination levels, traffic loading, road surface conditions, land routing configurations, visibility and calendar event data.

6. The method of claim 1, further comprising:

determining environmental conditions for a regional area encompassing roadways of the accident data;

in response to determining that the implementing the selected corrective action reduces occurrences of accidents matching common accident data of the clustered subset of accidents on the relevant roadway, determining whether implementation of the selected corrective action has an acceptable environmental impact on the environment conditions for the regional area; and increasing the selection weighting value of the selected corrective action in response to determining that the implementation of the selected corrective action has the acceptable environmental impact on the environment conditions for the regional area.

7. The method of claim 6, wherein the determining that the implementing the selected corrective action has the acceptable environmental impact on the environment conditions for the regional area comprises requiring a threshold percentage of accident reductions is met to justify an increase in a negative environmental impact on the environment conditions for the regional area.

8. The method of claim 1, further comprising:

integrating computer-readable program code into a computer system comprising a processor, a computer readable memory in circuit communication with the processor, and a computer readable storage medium in circuit communication with the processor; and wherein the processor executes program code instructions stored on the computer-readable storage medium via the computer readable memory and thereby performs the collecting the roadway attribute data that is associated with each of the plurality of different accidents within the historic accident data, the assigning the positive correlation values to correlated ones of the roadway attributes that match to the accident data, the clustering the subset of the different accidents as the function of sharing the threshold amount of common values of the subset of the roadway attributes assigned positive correlation values, the selecting the corrective action to obviate the first one of the subset of the roadway attributes that is assigned positive correlation values of the clustered subset of accidents, the determining whether the implementing the selected corrective action has reduced occurrences of accidents matching common accident data of the clustered subset of accidents on the relevant roadway, and the increasing the selection weighting value of the selected corrective action in response to determining that implementation of the selected corrective action has reduced occurrences of accidents matching common accident data of the clustered subset of accidents on the relevant roadway.

9. The method of claim 8, wherein the computer-readable program code is provided as a service in a cloud environment.

10. A roadway management system, comprising:

a processor;

a computer readable memory in circuit communication with the processor; and a computer readable storage medium in circuit communication with the processor;

wherein the processor executes program instructions stored on the computer-readable storage medium via the computer readable memory and thereby:

collects structured and unstructured roadway attribute data that is associated with each of a plurality of different accidents within historic accident data;

assigns positive correlation values to correlated ones of the roadway attributes that match to the accident data;

clusters a subset of the accidents as a function of each of the subset of the accidents sharing a threshold amount of common values of a subset of the roadway attributes assigned positive correlation values;

selects a corrective action to obviate a first one of the subset of the roadway attributes that is assigned positive correlation values of the clustered subset of accidents;

implements the selected corrective action by revising a posted speed limit displayed on a dynamic speed limit sign;

determines whether the implementing the selected corrective action has reduced occurrences of accidents matching common accident data of the clustered subset of accidents on a relevant roadway; and in response to determining that the implementing the selected corrective action has reduced occurrences of accidents matching common accident data of the clustered subset of accidents on the relevant roadway, increases a selection weighting value of the selected corrective action; and uses the selection weighting value to bias selection of the selected corrective action for implementation to obviate a roadway attribute with respect to another clustered subset of the accidents comprising roadway attributes that are assigned positive correlation values and that includes the first one of the subset of the roadway attributes.

11. The system of claim 10, wherein the first one of the subset of the roadway attributes is not labeled as being a contributive cause to an associated accident within the clustered subset of accidents.

12. The system of claim 10, wherein the threshold amount of common values is selected from the group consisting of a total number of the subset of the roadway attributes assigned positive correlation values, and a total of the positive correlation values assigned to the subset of the roadway attributes assigned positive correlation values.

13. The system of claim 10, wherein the roadway attribute data is selected from the group consisting of weather conditions, illumination levels, traffic loading, road surface conditions, land routing configurations, visibility and calendar event data.

14. The system of claim 10, wherein the processor executes the program instructions stored on the computer-readable storage medium via the computer readable memory and thereby:

determines environmental conditions for a regional area encompassing roadways of the accident data;

in response to determining that the implementing the selected corrective action reduces occurrences of accidents matching common accident data of the clustered subset of accidents on the relevant roadway, determines whether implementation of the selected corrective action has an acceptable environmental impact on the environment conditions for the regional area; and increases the selection weighting value of the selected corrective action in response to determining that the implementation of the selected corrective action has the acceptable environmental impact on the environment conditions for the regional area.

15. The system of claim 14, wherein the processor executes the program instructions stored on the computer-readable storage medium via the computer readable memory and thereby determines that the implementing the selected corrective action has the acceptable environmental impact on the environment conditions for the regional area by requiring a threshold percentage of accident reductions is met to justify an increase in a negative environmental impact on the environment conditions for the regional area.

16. A computer program product for a roadway management device, the computer program product comprising:

a computer readable storage medium having computer readable program code embodied therewith, wherein the computer readable storage medium is not a transitory signal per se, the computer readable program code comprising instructions for execution by a processor that cause the processor to:

collect structured and unstructured roadway attribute data that is associated with each of a plurality of different accidents within historic accident data;

assign positive correlation values to correlated ones of the roadway attributes that match to the accident data;

cluster a subset of the accidents as a function of each of the subset of the accidents sharing a threshold amount of common values of a subset of the roadway attributes assigned positive correlation values;

select a corrective action to obviate a first one of the subset of the roadway attributes that is assigned positive correlation values of the clustered subset of accidents;

implement the selected corrective action by revising a posted speed limit displayed on a dynamic speed limit sign;

determine whether the implementing the selected corrective action has reduced occurrences of accidents matching common accident data of the clustered subset of accidents on a relevant roadway; and in response to determining that the implementing the selected corrective action has reduced occurrences of accidents matching common accident data of the clustered subset of accidents on the relevant roadway, increase a selection weighting value of the selected corrective action; and use the selection weighting value to bias selection of the selected corrective action for implementation to obviate a roadway attribute with respect to another clustered subset of the accidents comprising roadway attributes that are assigned positive correlation values and that includes the first one of the subset of the roadway attributes.

17. The computer program product of claim 16, wherein the first one of the subset of the roadway attributes is not labeled as being a contributive cause to an associated accident within the clustered subset of accidents.

18. The computer program product of claim 16, wherein the roadway attribute data is selected from the group consisting of weather conditions, illumination levels, traffic loading, road surface conditions, land routing configurations, visibility and calendar event data.

19. The computer program product of claim 16, wherein the computer readable program code instructions for execution by the processor further cause the processor to:

determine environmental conditions for a regional area encompassing roadways of the accident data;

in response to determining that the implementing the selected corrective action reduces occurrences of accidents matching common accident data of the clustered subset of accidents on the relevant roadway, determine whether implementation of the selected corrective action has an acceptable environmental impact on the environment conditions for the regional area; and increase the selection weighting value of the selected corrective action in response to determining that the implementation of the selected corrective action has the acceptable environmental impact on the environment conditions for the regional area.

20. The computer program product of claim 19, wherein the computer readable program code instructions for execution by the processor further cause the processor to determine that the implementing the selected corrective action has the acceptable environmental impact on the environment conditions for the regional area by requiring a threshold percentage of accident reductions is met to justify an increase in a negative environmental impact on the environment conditions for the regional area.

* * * * *